United States Patent [19]

Wehmeyer et al.

[11] Patent Number: 4,518,061

[45] Date of Patent: May 21, 1985

[54] TRANSLATING MOBILE WORK PLATFORM

[75] Inventors: Donald T. Wehmeyer, Roselle; Ronald W. Barnhart, Elmhurst, both of Ill.

[73] Assignee: Economy Engineering, Inc., Bensenville, Ill.

[21] Appl. No.: 489,039

[22] Filed: Apr. 27, 1983

[51] Int. Cl.[3] ..... B66B 11/04

[52] U.S. Cl. ..... 187/18; 254/122; 182/141

[58] Field of Search ..... 187/18, 8.71, 8.45; 254/122, 3 R; 182/141, 148, 63, 69

[56] References Cited

U.S. PATENT DOCUMENTS

| | | | |
|---|---|---|---|
| Re. 29,542 | 2/1978 | Richards | 187/18 |
| 3,820,631 | 6/1974 | King et al. | 182/141 |
| 4,088,203 | 5/1978 | Smith, Jr. | 187/18 |
| 4,221,280 | 9/1980 | Richards | 187/18 |
| 4,343,379 | 8/1982 | Haulotte | 187/18 |

FOREIGN PATENT DOCUMENTS

| | | | |
|---|---|---|---|
| 2622408 | 9/1976 | Fed. Rep. of Germany | 254/122 |

*Primary Examiner*—Joseph J. Rolla
*Assistant Examiner*—Kenneth Noland
*Attorney, Agent, or Firm*—Douglas B. White

[57] ABSTRACT

A translating mobile work platform is provided having a telescoping scissors mechanism comprising a lower and upper member confined to telescope within an intermediate member and having a system to equalize the motion of said upper and lower members, and further comprising fluidic circuitry to control the motion of the limbs of the scissors to provide level translational motion of the work platform by feeding fluid pressure from the upper portion of one cylinder to the upper portion of the other.

5 Claims, 3 Drawing Figures

TRANSLATING MOBILE WORK PLATFORM

BACKGROUND OF THE INVENTION

The present invention concerns apparatus for raising objects or people vertically and more particularly mobile work platforms using telescoping support arms articulated together in the form of scissors. Prior systems, such as disclosed by Smith, U.S. Pat. No. 4,088,203, does not use telescoping scissors, requires six hydraulic cylinders to operate the lift, and cannot impart translating motion to the platform. Moreover, the Richard's disclosure, U.S. Pat. No. RE 29,542, while using a simple scissors, requires large expansible cylinders for operation and likewise cannot translate. Lastly, the Haulotte disclosure, U.S. Pat. No. 4,343,379, uses a telescoping scissors concept and is capable of translation during elevation, but has a serious drawback since no leveling control is provided with the translation.

SUMMARY OF THE INVENTION

Accordingly, there is now provided in the preferred embodiment of the present invention an improved telescoping scissors apparatus for a mobile work platform, having a telescopic scissor arrangement actuated by fluidic circuitry and hydraulic cylinders, wherein each limb of the scissor is constituted of three elements whereby a lower section and an upper section each telescope into a mid section. Further, within said mid section, motion limiting means is provided to equalize the motion of the lower section and the upper section with respect to the mid section. In the controlling fluidic circuitry there is provided means to control the motion of the limbs to provide differential movement of the scissor limbs and, thereby, level translational motion of the elevated platform.

Accordingly, it is the primary aim of the present invention to provide an improved extensible scissor apparatus for a mobile work platform using controlled fluidic circuitry to obtain translation.

It is a further object to provide fluidic controlled scissor limbs which provide level translational motion of the platform.

Other objects and advantages will become apparent upon reading the following detailed description, and upon reference to the drawings in which.

While the invention will be described in connection with the preferred embodiment, it will be understood that we do not intend to limit the invention to that embodiment. On the contrary, we intend to cover all alternatives, modifications and equivalents as may be included within the spirit and scope of the invention as defined by the appended claims.

DESCRIPTION OF THE PREFERRED EMBODIMENT

Figure 1:
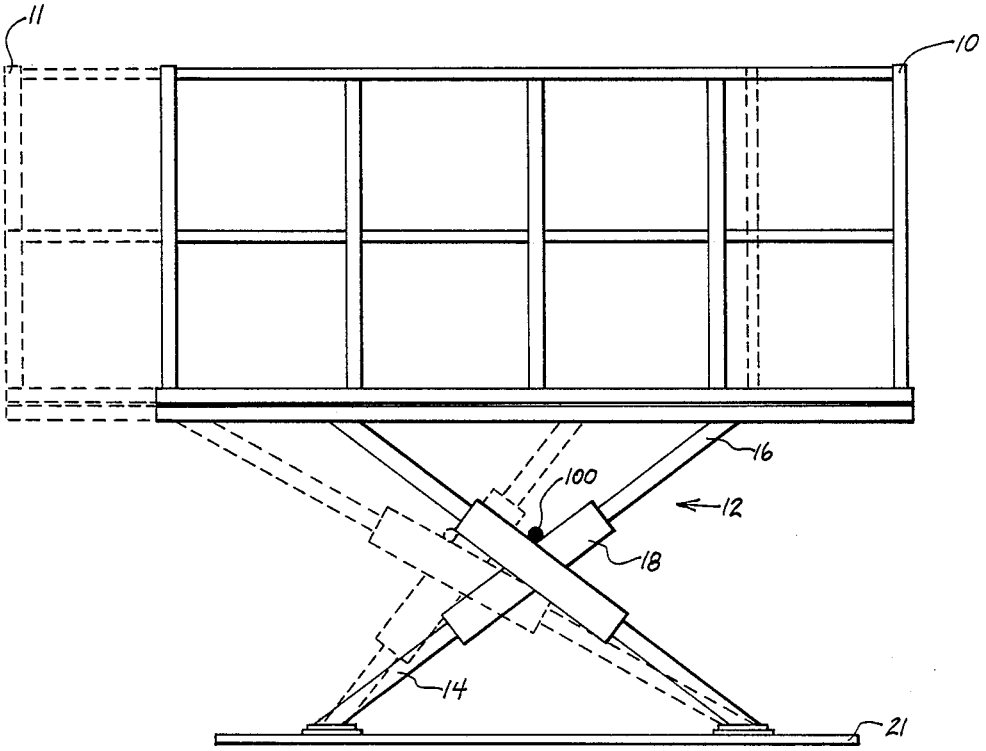
FIG. 1 is a front elevational view of the translating platform of the present invention.

Turning first to FIG. 1 there is shown the elevating platform 10 shown in its raised position. Shown in dotted lines 11 the platform is represented as translated to the left. Supporting the platform are paired extensible scissor limbs 12 having a lower section 14, an upper section 16 and an intermediate section 18. During vertical movement of the platform, both limbs move in identical fashion; while in translational movement, differential movement of the telescoping limbs is achieved as more fully described below.

Turning now to FIG. 2 there is, once again, shown the upper member of the scissor limb 16, the lower member of the scissor limb 14 and the intermediate member of the scissor limb 18. This intermediate member operates as a casing confining the ends of the upper and lower limb sections for translational motion. The upper and lower sections of the limb translate within channels in this intermediate section and are constrained therein to maintain longitudinal alignment.

Figure 2:
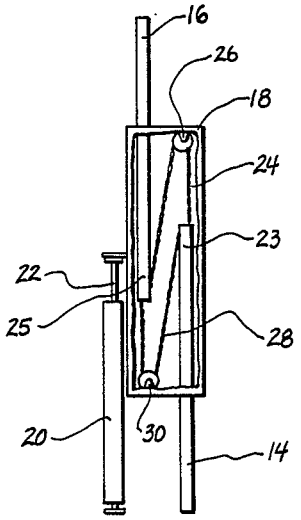
FIG. 2 is a detailed view of the intermediate member of a scissors limb of FIG. 1.

Actuating the telescoping limb is a hydraulic cylinder 20 shown in FIG. 2 rigidly attached at its piston end to the intermediate member 18 and hingedly attached at its other end to the base 21 of the mobile work platform. Extension of the piston 22 from the cylinder displaces the intermediate member 18 with respect to the base 21 of the mobile work platform.

During the extension of the piston of the hydraulic cylinder and the corresponding movement of the intermediate member away from the base, the confined end 23 of the lower member of the limb is caused to pull upon chain 24 attached thereto. The chain 24 traverses a pulley 26 affixed to the upper end of the intermediate member 18 and thence travels downward where it is affixed to the confined end 25 of the upper limb section. Therefore movement of the intermediate member with respect to the base 21 causes the upper section to be displaced outwardly from the intermediate section in an amount equal to the displacement of the intermediate member with respect to the base.

During descent, the chain 28 affixed to the confined ends of the upper and lower sections and traversing a pulley 30 affixed to the lower portion of the mid section, pulls the upper section into the mid section as the lower section is caused to retract into the mid section to maintain equal displacement of the upper and lower sections with respect to the mid section.

Figure 3:
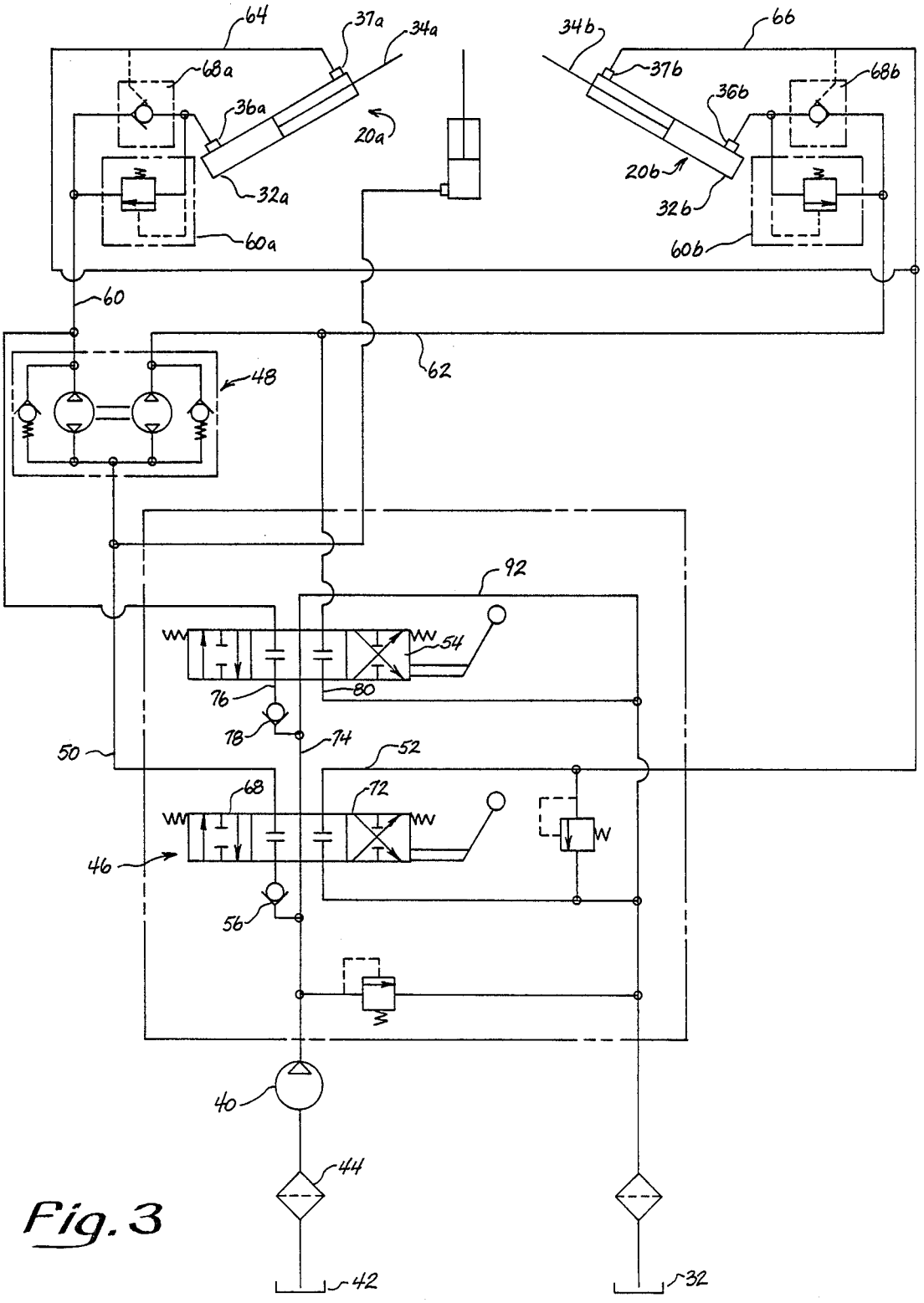
FIG. 3 is a schematic of the fluidic control system of the present invention.

The controlling fluidic circuitry is shown in FIG. 3. The hydraulic cylinders 20*a* and 20*b* are shown schematically, each having a respective closed cylinder end 32*a* and 32*b* and having respective open ends with protruding piston rods 34*a* and 34*b*. These are double acting cylinders and have fluidic pressure inlets at the closed ends 36*a* and 36*b* and at the open ends 37*a* and 37*b*.

Pressure to these cylinders is provided via a hydraulic pump 40 pumping fluid from a tank reservoir 42 through an in line filter 44. To provide the basic lift function, there is provided a three-position fluidic valve 46 whereby pressure is fed selectively to either the upper or lower ends of the hydraulic cylinders. More particularly, with the three-way valve positioned in its middle position, as shown, a conduit 50 for feeding pressure to the lower portion of the cylinders is shown blocked. Similarly the conduit 52 for feeding pressure to the upper portions of the cylinders is also blocked. At the same time, the pressure from the pump is shown being passed through to the translation control valve 54 as will be more fully described below.

Shifting the lift valve 46 to position the left hand side into communication with the pump and tank lines will feed the tank and pressure flow as shown by the arrows marked on the valve schematic. Consequently, pressure will be fed through the check valve 56 to the conduit 50 to the flow divider 58 shown within the dotted lines. This flow divider is commonly in use in the industry and hence will not be described in detail here. Generally, this flow divider equalizes the flow into the conduits 60 and 62 feeding the lower portions of the hydraulic cylinders and equalizing the lift of the platform. With the lower portion of the hydraulic cylinder pressurized, fluid is caused to flow from the orifice on the piston end 37*a* and 37*b* as the platform rises. This return flow then preceeds through the conduits 64 and 66 to the tank connection 68 at the lift valve.

Shifting of the right portion of the lift valve into the pressure and tank connections, supplies pressure through the check valve 56 to the conduit 52 and, hence, to the upper orifice 37*a* and 37*b* of the hydraulic piston through conduits 64 and 66. This then causes the piston to shift under pressure in a downward direction and fluid is thereby forced out of the lower orifice 36*a* and 36*b* of the hydraulic cylinders. The return flow of fluid then proceeds through the lock valves 68*a* and 68*b* to provide a controlled descent of the platform. These valves provide a controlled flow therethrough only upon the sensing of appropriate fluid pressure at the orifice 37*a* and 37*b* respectively. Following these valves, the fluid is directed through the flow control equalizer 48 which maintains the equal travel and equilibrium of the platform during descent. From there the fluid returns to the tank via the conduit 50 to the tank connection 72 on the lift valve.

The translating valve 44 is available for operation when the lift valve is located with its center position in operative connection as shown in FIG. 3. In that position pressure is fed through the lift valve 46 to conduit 74 providing pressure to the pressure connection 76 at the translating valve through the check valve 78. Tank pressure, however, is maintained at all times to the translating valve at the tank connection 80. With the translating valve in its center position as shown in FIG. 3, the line pressure is shunted to tank via conduit 92.

In shifting the left portion of the translating valve into operative communication with the pressure and tank connections 76 and 80 respectively, pressure is shunted directly to conduit 60 where it flows to the lower left portion 32*a* of the left hydraulic lift cylinder. Concurrently therewith the tank line is connected to the conduit 62, hence providing tank to the lower portion 32 *b* of the right hydraulic cylinder. While the left cylinder expands, fluid is forced from its upper orifice 37*a* via conduit 64 to the upper port 37*b* of the right cylinder causing the piston therein to lower proportionately. Fluid forced from the lower portion of the right cylinder is then fed back to tank via conduit 62 and tank connection 80.

With the right portion of the hydraulic cylinder shifted into operative communication with the pressure connection 76 and the tank connection 80, pressure is provided on conduit 62 and fed therethrough to the port 36*b* of the lower portion 32*b* of the right hydraulic cylinder. Concurrently therewith, tank is connected directly to conduit 60, and hence providing tank to the lower portion of the left cylinder. In the same manner as above, the right cylinder expands while the left contracts.

Turning once again to FIGS. 1 and 2, it can be seen that each hydraulic cylinder operates to displace the intermediate member 18 of the telescopic supports. By so displacing this intermediate member with respect to the base, the length of the support increases. By shortening the length of one support (one limb of the scissor) and increasing the length of the other support, a translation is achieved as shown in FIG. 1. In the preferred embodiment there is further provided an interconnecting axle 100 joining said paired intermediate members for stability.

Accordingly, there has been described an improved translating platform having a telescopic scissor arrangement operated by fluidic circuitry and hydraulic cylinders whereby level translational motion is achieved by feeding fluid pressure from the upper portion of one cylinder to the upper portion of the other. Each scissor limb is comprised of lower, upper, and mid sections wherein said lower and upper sections are mechanically controlled to telescope into said mid section.

We claim:

1. An improved lift mechanism comprising:

(a) a base member;

(b) a support platform arranged above said base in substantially parallel orientation for movement with respect to said base;

(c) a scissors mechanism comprising a first and a second telescoping arm, each comprising:

(i) a lower member hingedly connected at one end to said base, and having its other end confined for relative translational motion, (ii) an upper member hingedly affixed at one end to said platform and having its other end confined for relative translational motion, (iii) an intermediate member arranged to confine said lower and said upper members for relative translational motion, and (iv) means for equalizing the motion of the lower and upper members relative to said intermediate member;

(d) a first and second fluid operated cylinder arranged to drive said intermediate members of said first and second telescoping arms respectively, each cylinder being double acting and having one end fixed to said intermediate member and its other end hingedly attached to said base, each cylinder having a first port for inlet of pressurized fluid during ascent of said platform and the outlet of pressurized fluid during descent of said platform and having a second port for the inlet of pressurized fluid during descent of said platform and the outlet of pressurized fluid during ascent of said platform;

(e) means to selectively provide simultaneous fluidic communication of said pressurized fluid to said first ports of said first and second cylinders while allowing fluid flow from said second ports; and (f) means to selectively provide fluidic communication of pressurized fluid to a first port of one of said cylinders while allowing fluid flow from said first port of the other of said cylinders and to provide fluidic communication between said second ports of said cylinders, whereby the motion of said first and second cylinders occurs in substantially equal increments but opposite direction.

2. An improved lift mechanism comprising:

(a) a base member;

(b) a support platform arranged above said base in substantially parallel orientation for movement with respect to said base;

(c) a scissors mechanism comprising a first and a second telescoping arm, each comprising:

(i) a lower member hingedly connected at one end to said base, and having its other end confined for relative translational motion, (ii) an upper member hingedly affixed at one end to said platform and having its other end confined for relative translational motion, (iii) an intermediate member arranged to confine said lower and said upper members for relative translational motion, (iv) means for displacing said intermediate member with respect to said base member, and (v) means for equalizing the motion of the lower and upper members relative to said intermediate member comprising:

a pulley member rotatively attached to the lower end of said intermediate member; and a flexible tensile member securely attached at one end to said confined end of said lower member, passing under and in supporting relation to said pulley member, and securely attached at its other end to said confined end of said upper member.

3. The apparatus of claim 2 wherein said means for displacing said intermediate member with respect to said base members comprises:

(a) a first and second fluid operated cylinder arranged to drive said intermediate members of said first and second telescoping arms respectively, each cylinder being double acting and having one end fixed to said intermediate member and its other end hingedly attached to said base, each cylinder having a first port for inlet of pressurized fluid during ascent of said platform and the outlet of pressurized fluid during descent of said platform and having a second port for the inlet of pressurized fluid during descent of said platform and the outlet of pressurized fluid during ascent of said platform;

(b) means to selectively provide simultaneous fluidic communication of said pressurized fluid to said first ports of said first and second cylinders while allowing fluid flow from said second ports; and (c) means to selectively provide fluidic communication of pressurized fluid to a first port of one of said cylinders while allowing fluid flow from said first port of the other of said cylinders and to provide fluidic communication between said second ports of said cylinders, whereby the motion of said first and second cylinders occurs in substantially equal increments but opposite direction.

4. An improved lift mechanism comprising:

(a) a base member;

(b) a support platform arranged above said base in substantially parallel orientation for movement with respect to said base;

(c) a scissors mechanism comprising a first and a second telescoping arm, each comprising:

(i) a lower member hingedly connected at one end to said base, and having its other end confined for relative translational motion, (ii) an upper member hingedly affixed at one end to said platform and having its other end confined for relative translational motion, (iii) an intermediate member arranged to confine said lower and said upper members for relative translational motion, (iv) means for displacing said intermediate member with respect to said base member, and (iv) means for equalizing the motion of the lower and upper members relative to said intermediate member comprising:

a pulley member rotatively attached to the upper end of said intermediate member; and a flexible tensile member securely attached at one end to said confined end of said upper member, passing around said pulley member, and securely attached at its other end to said confined end of said lower member.

5. The apparatus of claim 4 wherein said means for displacing said intermediate member with respect to said base members comprises:

(a) a first and second fluid operated cylinder arranged to drive said intermediate members of said first and second telescoping arms respectively, each cylinder being double acting and having one end fixed to said intermediate member and its other end hingedly attached to said base, each cylinder having a first port for inlet of pressurized fluid during ascent of said platform and the outlet of pressurized fluid during descent of said platform and having a second port for the inlet of pressurized fluid during descent of said platform and the outlet of pressurized fluid during ascent of said platform;

(b) means to selectively provide simultaneous fluidic communication of said pressurized fluid to said first ports of said first and second cylinders while allowing fluid flow from said second ports; and (c) means to selectively provide fluidic communication of pressurized fluid to a first port of one of said cylinders while allowing fluid flow from said first port of the other of said cylinders and to provide fluidic communication between said second ports of said cylinders, whereby the motion of said first and second cylinders occurs in substantially equal increments but opposite direction.

* * * * *